US009770078B1

(12) United States Patent
Chiles

(10) Patent No.: US 9,770,078 B1
(45) Date of Patent: Sep. 26, 2017

(54) PORTABLE ERGONOMIC ADJUSTABLE JEWELERS WORK STATION SYSTEM

(71) Applicant: Fendol Chiles, Dallas, TX (US)

(72) Inventor: Fendol Chiles, Dallas, TX (US)

( * ) Notice: Subject to any disclaimer, the term of this patent is extended or adjusted under 35 U.S.C. 154(b) by 0 days.

(21) Appl. No.: 15/176,591

(22) Filed: Jun. 8, 2016

(51) Int. Cl.
*B25B 1/00* (2006.01)
*A44C 27/00* (2006.01)
*B25H 1/10* (2006.01)

(52) U.S. Cl.
CPC ..... *A44C 27/00* (2013.01); *B25H 1/10* (2013.01)

(58) Field of Classification Search
CPC B25B 1/00; B25B 1/2452; B25B 5/00; B25B 5/067; B25B 5/101; B25B 5/125; B25B 5/16; B25B 11/007; B25H 1/10; A44C 27/00
See application file for complete search history.

(56) References Cited

U.S. PATENT DOCUMENTS 6,604,737 B1 * 8/2003 Garrett ..... B25H 1/12 269/11

* cited by examiner

*Primary Examiner* — Larry E Waggle, Jr.
*Assistant Examiner* — Nirvana Deonauth
(74) *Attorney, Agent, or Firm* — Warren V. Norred; Norred Law, PLLC

(57) ABSTRACT

The present invention is a jeweler's bench pin with an adjustable height and extension function, and capable of serving as a mount for various jewelers' tools, such as a soldiering iron and lighting.

3 Claims, 6 Drawing Sheets

PORTABLE ERGONOMIC ADJUSTABLE JEWELERS WORK STATION SYSTEM

FIELD OF THE INVENTION

The present invention relates to a bench pin system used for jewelry manufacture and repair.

BACKGROUND

A "bench jeweler" is a contemporary term often used to describe an all-around jeweler who has a larger set of skills than that of a production worker who merely files and solders rings. A bench jeweler usually has a wide range of knowledge and capable of original design, including major metal work, brazing, stone-setting, and finishing with fair ability.

A 'bench pin' is an operating surface developed over centuries by jeweler to provide a work surface customized for holding jewelry elements in place while the jeweler cuts, soldiers, and sands them, among other operations.

Bench pins are widely available from a multitude of sources, including small specialty jeweler suppliers, craft-oriented vendors, and online sources.

Bench pins tend to employ a clamp to mount their operating surface to a table top so the surface extends away from the table on which it is mounted and toward the user, so the table does not interfere with the user's arms or tools as they work jewelry pieces.

Every industry-standard bench pin has certain tools, including a v-shaped notch cut out of the surface, so users can use a cutting device that extends below the jewelry element. Other common elements include a pull-out tray to store oft-used supplies, some sort of lighting, and sinusoidal surfaces necessary to work round parts, such as rings.

Jewelers try to maintain their work surface at a vertical height between their shoulders and eye level, so they can view their work easily. This often presents a challenge, as tables and typical bench pins are mounted by placing the work surface on the mounting surface, and then using a simple clamp to hold the bench pin to the table. The end result is that jewelers often have to sit on a low chair, or bend to maintain the proper eye height of about the same height as the user's collar bone.

Jewelers also struggle with the extent of the bench pin from the table on which it is mounted. Bench pins are typically constructed so there is little range of extension—the mounting clamp of a bench pin must be mounted so it will hold the surface in place, and may have a couple of inches of adjustment, and often less.

Master jewelers who are teaching students struggle with bench pins as described, as available bench pins are not easily adjusted. That lack of adjustment leads to situations where a student may have a work station and seat that is correct for the student, but difficult for the master to use if he should need to demonstrate a technique.

The jewelry industry needs a bench pin that is easily adjusted without interim dismounting from a table mounting position, both by height and extension from the table.

This background information is provided to reveal information believed by the applicant to be of possible relevance to the present invention. No admission is intended, nor should be construed, that any of the preceding information constitutes prior art against the present invention.

SUMMARY OF THE INVENTION

With the above in mind, embodiments of the present invention are related to a Portable Ergonomic Adjustable Bench Pin System.

The invention is adjustable in both the vertical and horizontal directions, and includes many tools that can be arranged in a multitude of configurations.

DETAILED DESCRIPTION OF THE INVENTION

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Those of ordinary skill in the art realize that the following descriptions of the embodiments of the present invention are illustrative and are not intended to be limiting in any way. Other embodiments of the present invention will readily suggest themselves to such skilled persons having the benefit of this disclosure. Like numbers refer to like elements throughout.

In this detailed description of the present invention, a person skilled in the art should note that directional terms, such as "above," "below," "upper," "lower," and other like terms are used for the convenience of the reader in reference to the drawings. Also, a person skilled in the art should notice this description may contain other terminology to convey position, orientation, and direction without departing from the principles of the present invention.

Furthermore, in this detailed description, a person skilled in the art should note that quantitative qualifying terms such as "generally," "substantially," "mostly," and other terms are used, in general, to mean that the referred to object, characteristic, or quality constitutes a majority of the subject of the reference. The meaning of any of these terms is dependent upon the context within which it is used, and the meaning may be expressly modified.

Referring now to FIGS. 1-5, and according to an embodiment of the present invention disclosed is a Bench Pin 11 used by jewelers to create or repair jewelry comprising an assembly of a Clamp 13, V-Slot 15 constructed into a Surface 19, affixed to a Post 17, to which many tools may be affixed using a Thumbscrew Mounting Bracket 39. Those tools comprise a Stationary Ring 23, Sinusoidal Stake 25, Soldering Iron Magnet 27, Light 29, Wire Holder 33, Rotating Solder Wheel 43, as further described below.

The construction can include an optional Extension Adjustment Mechanism 21 that allows a user to adjust the horizontal distance that the bench pin extends away from the table or user.

This Bench Pin 11 differs from the products offered in the market today by addressing the ergonomic needs of jewelers, including an easily adjustable height, and extension in relation to the desk on which the bench pin is mounted, so the Surface 19 on which most of the work is accomplished can be set at the right height, typically about the user's collar bone, so a jeweler can see the work performed without hunching over.

The Bench Pin 11 is mounted to a surface by a Clamp 13, known and common in the industry.

Figure 4:
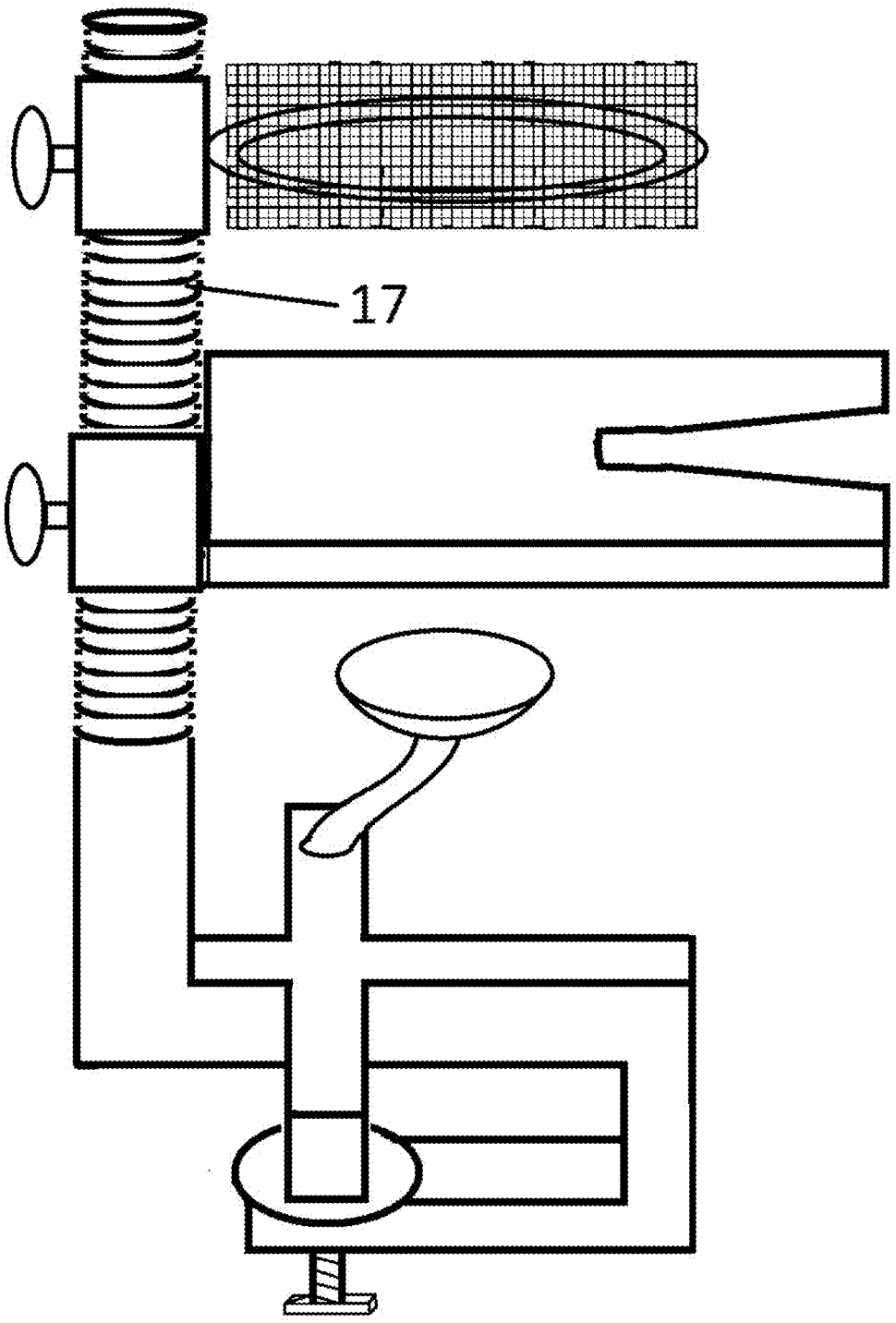
FIG. 4 is a side view of a fourth embodiment of the invention, using all-thread rod.

A Post 17 is affixed to the Clamp 13 so the Post 17 rises into the space above the Clamp 13. The Post 17 may be a simple smooth rod, to which other components may be clamped, or other constructions using ratcheted or saw-tooth edges, or an all-thread rod construction as shown in FIG. 4, so items can be screwed onto the Post 17, and easily turned to the right or the left by the user.

Figure 1:
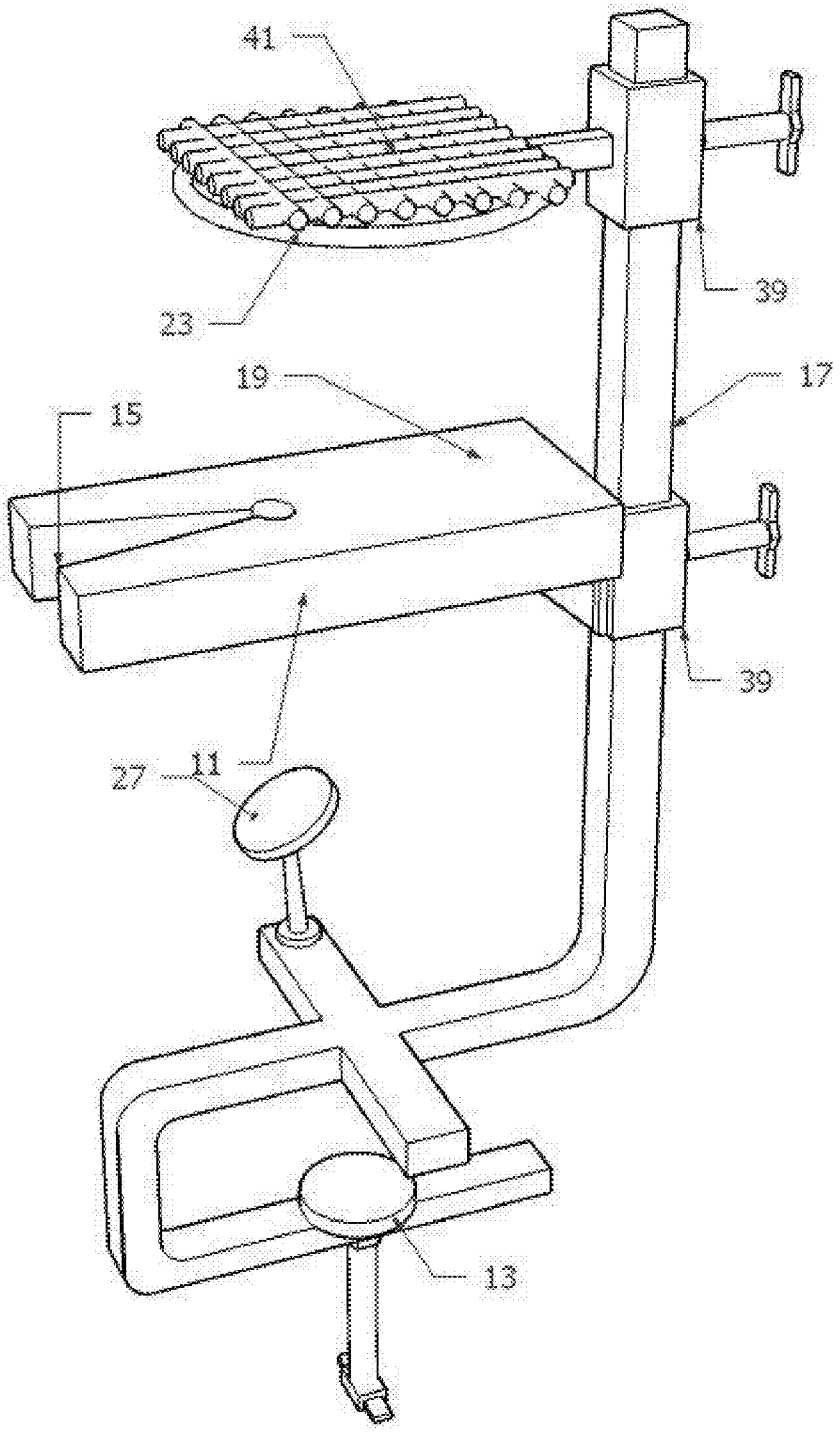
FIG. 1 is a front orthogonal view of one embodiment of the invention.

The Post 17 can be mounted to the Clamp 13 so it is one fixed piece, or the Post 17 could be mounted in many ways so that the Post 17 and Clamp 13 can be separated. FIG. 1 shows the permanently mounted one-piece construction, but it could also be constructed with multiple pieces, so long as that construction creates a sturdy and rugged surface that can survive the user's hammer on the Surface 19 and maintain its shape. For this reason, the best embodiment is a single-piece construction.

As shown in FIG. 1, the V-Slot 15 appears as a typical bench pin working Surface 19, but is constructed to be mounted to the Post 17 using the matching connection appropriate for the Post 17 construction. If the Post 17 is an all-thread post (as shown in FIG. 4, then the V-Slot 15 and Surface 19 are constructed to match the threads of the Post 17. Many types of construction are available, such as a ratcheting edge similar to a car jack, or a round post with a series of mounting holes through which pins could be used to affix the Surface 19 at a set height.

Figure 5:
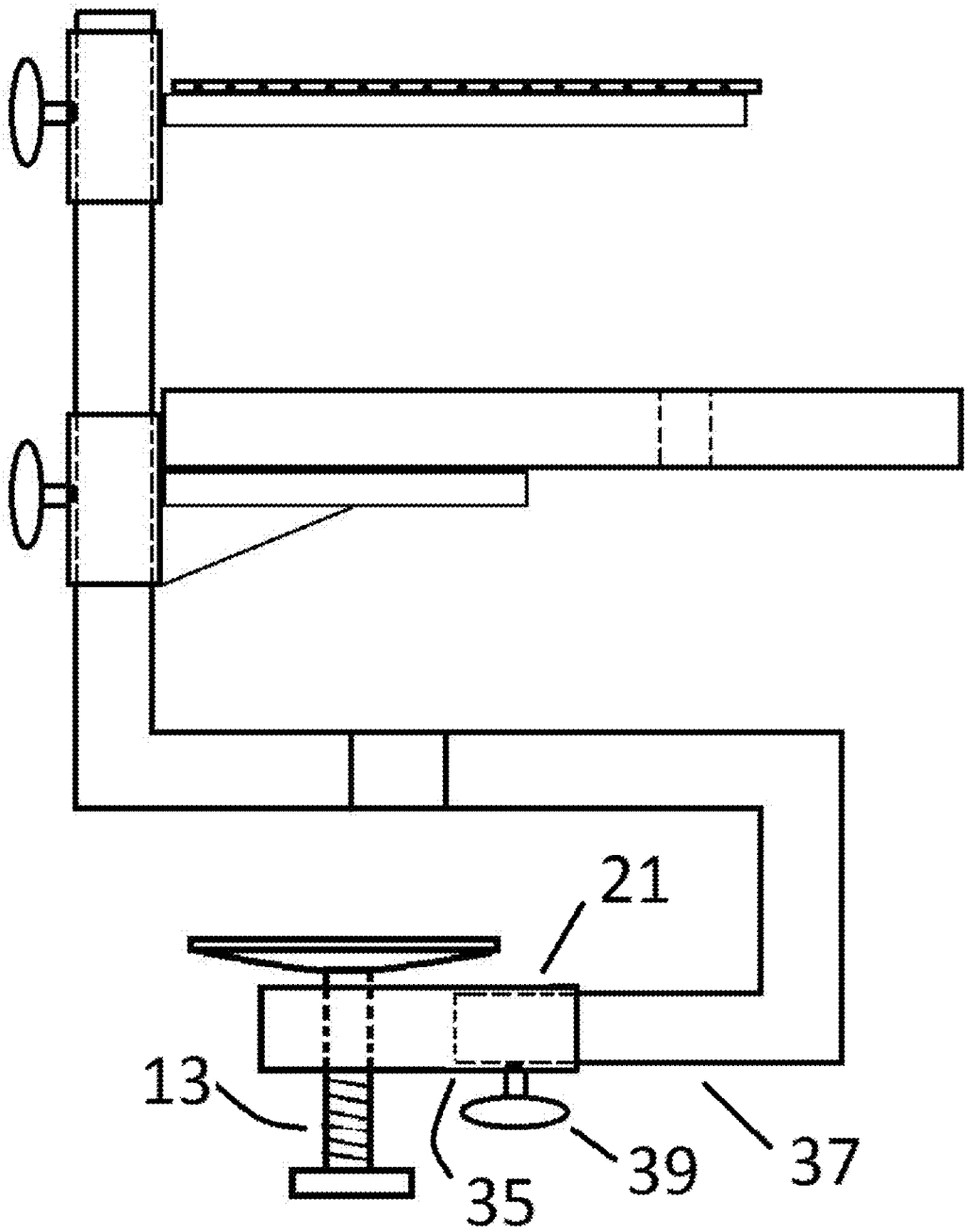
FIG. 5 is a side view of a fifth embodiment of the invention constructed with an extension adjustment mechanism.

One embodiment of the Extension Adjustment Mechanism is shown in FIG. 5. The purpose of the Extension Adjustment Mechanism is to allow a user to adjust the distance that the Post 17 and the devices mounted on it to extend from the table toward the user.

Many methods could be used to fix the distance, but as an example, the embodiment shown uses a simple rectangular Slide 35 on which the Clamp 13 is affixed. A user slides the Beam 37 through the Slide 35 and fixes it in place with a common Thumbscrew Mounting Bracket 39 which presses the Slide 35 against the Beam 37 so their position is fixed by pressure between a thumbscrew-headed bolt and the Slide 35. The user can therefore easily loosen the Beam 37 from the Slide 35 to adjust the horizontal distance between the user and the Surface 19.

Figure 2A:
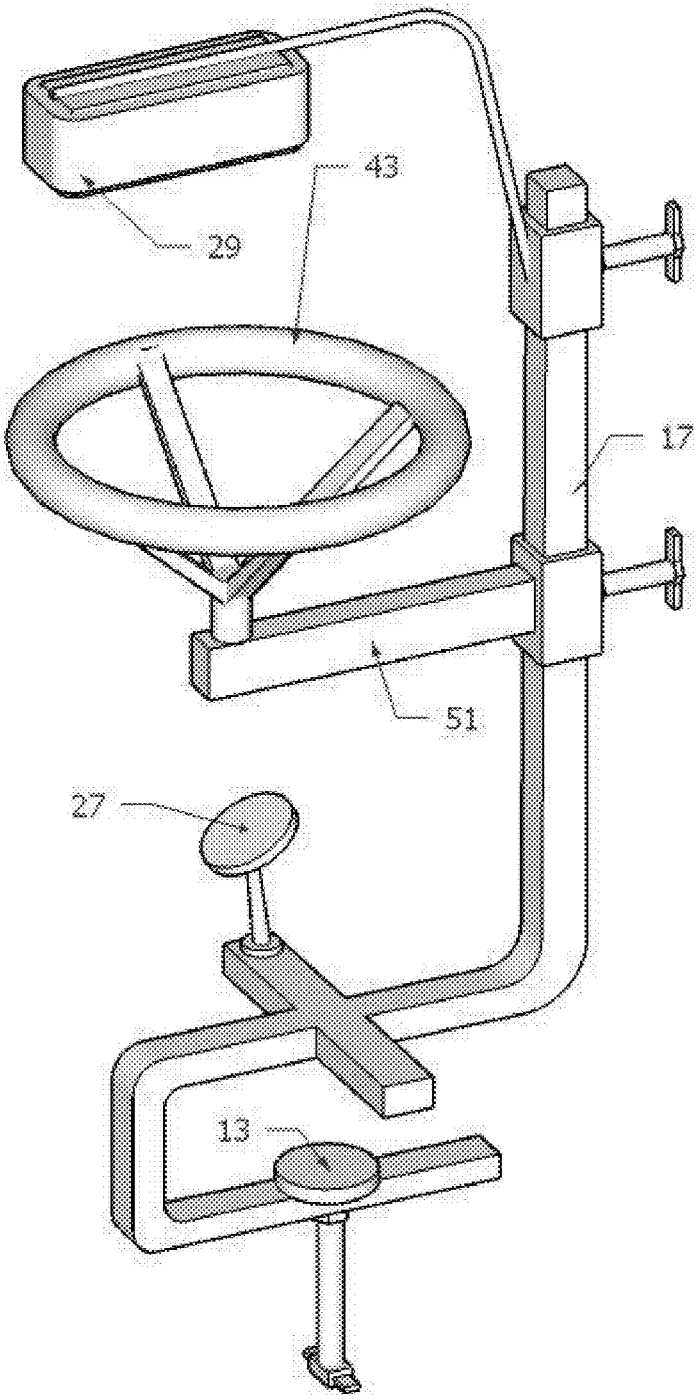
FIG. 2A is a front orthogonal view of a second embodiment of the invention.
Figure 2B:
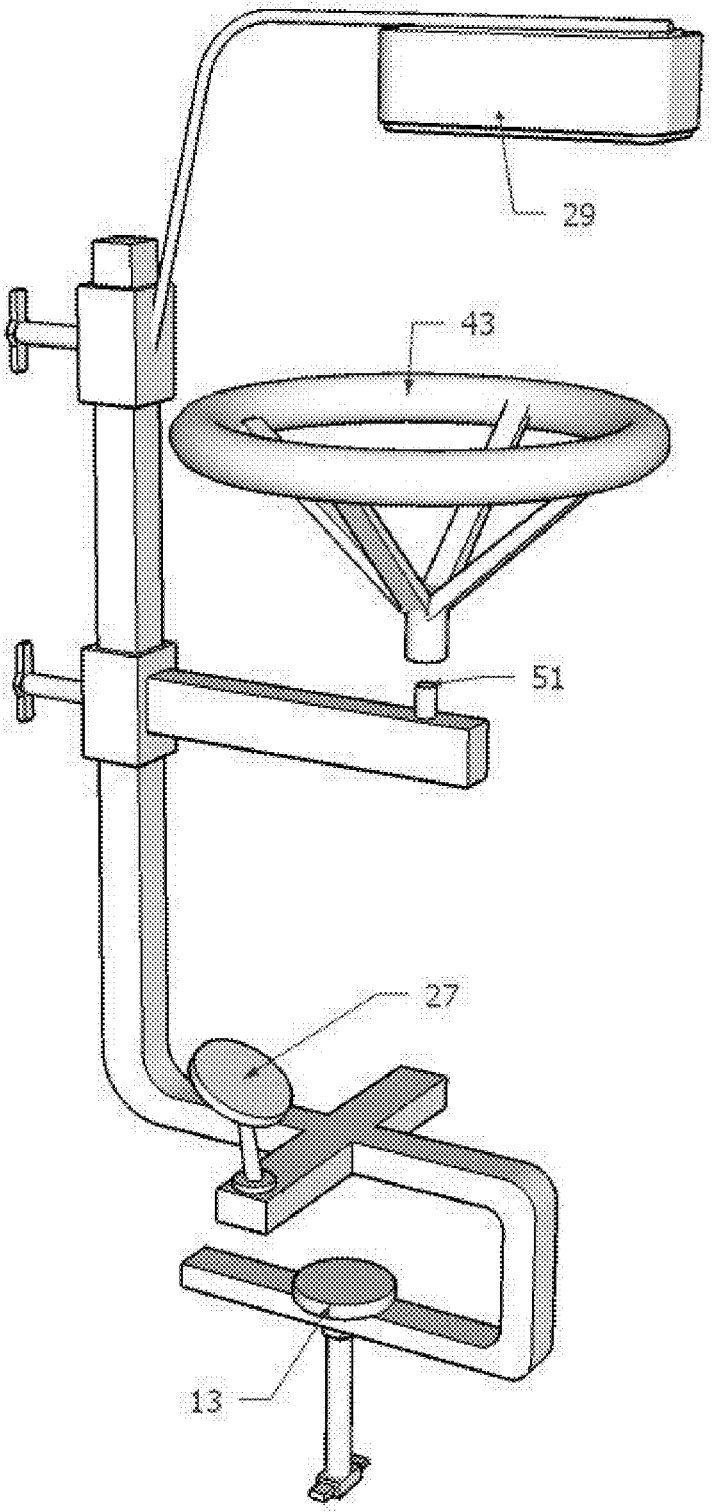
FIG. 2B is a front orthogonal view of the second embodiment of the invention, showing the exploded view of the Rotating Solder Wheel construction.
Figure 3:
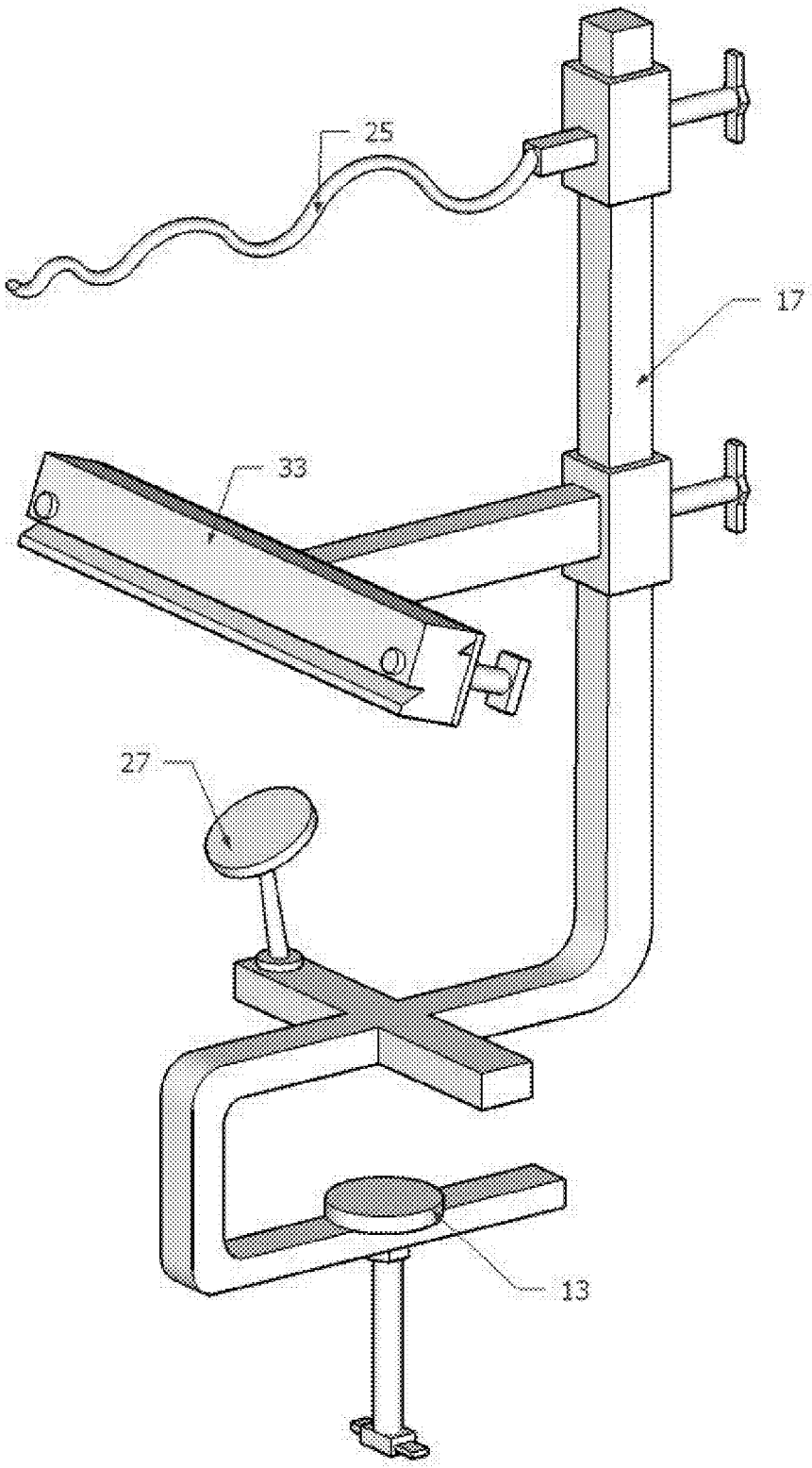
FIG. 3 is a front orthogonal view of a third embodiment of the invention.

Just as shown with the V-Slot 15, many other jeweler tools can be mounted on the Post 17, including Stationary Ring (seen on FIG. 1), Sinusoidal Stake 25 (seen on FIG. 3), Soldering Iron Magnet 27 (seen on all the figures), Wire Holder 33 (see in FIG. 3), and Light 29 (seen on FIGS. 2A and 2B).

In the current embodiment and as shown in the drawings, the Soldering Iron Magnet 27 is a magnet that is mounted on the base of the invention and provides the user with an easy place to put his soldering iron or other tool temporarily, as many of the jeweler's tools are ferrous.

The magnet 27 can hold a soldering iron away from other tools or jewelry that may be otherwise damaged from its heat, but the magnet can be used as a holding element for screwdrivers, pliers, or any number of other tools.

In particular, the invention comprises a hollow concave Rotating Solder Wheel 43, as shown in FIGS. 2A and 2B. The Wheel 43 sits on a Mount 45 so a user can place a curved surface into the hollow of the Wheel and rotate it for easy soldering or other tooling of a piece of jewelry without the user physically moving either himself or his tools.

A legend of the components discussed in the application and shown on the drawings is as follows:

Bench Pin 11
Clamp 13,
V-Slot 15,
Post 17,
Surface 19,
Extension Adjustment Mechanism 21,
Stationary Ring 23,
Sinusoidal Stake 25,
Soldering Iron Magnet 27,
Light 29,
Wire Holder 33,
Slide 35
Beam 37
Thumbscrew Mounting Bracket 39
Rotating Solder Wheel 43

The inventor claims:

1. A portable ergonomic adjustable jewelers work station system, comprising the following:

a. a clamp,
b. a post mounted vertically on the clamp,
c. a flat surface mountable on the post at a user-selected height,
d. a v-shaped slot in the flat surface,
e. a magnetic tool holder,
f. a stationary ring,
g. a sinusoidal stake,
h. a light,
i. wire holder,
j. rotatable solder wheel, with a concave interior, which allows a user to rotate jewelry or other elements without touching them.

2. The work station as discussed in claim 1 with a horizontal extension adjustment mechanism mounted between the clamp and the post, further comprising:

a. a horizontal beam mounted on the clamp,
b. a slide section on which the post is mounted, such that the slide section fits inside and allows for motion along an interior of the horizontal beam,
c. a means for holding the slide section in place in relation to the beam.

3. The work station as discussed in claim 2, in which the means for holding the slide section in place is a thumbscrew mounting bracket.

* * * * *